US005564476A

United States Patent [19]

Golz

[11] Patent Number: 5,564,476

[45] Date of Patent: Oct. 15, 1996

[54] ELASTICIZED DOUBLE WALL TUBULAR CORD

[75] Inventor: Robert E. Golz, Swansea, Mass.

[73] Assignee: Murdock Webbing Company, Inc., Central Falls, R.I.

[21] Appl. No.: 543,089

[22] Filed: Oct. 13, 1995

[51] Int. Cl.[6] ..... D03D 3/02

[52] U.S. Cl. ..... 139/388; 139/387 R; 428/36.1

[58] Field of Search ..... 160/344; 139/388, 139/387 R; 57/225; 428/36.1

[56] References Cited

U.S. PATENT DOCUMENTS

| | | | |
|---|---|---|---|
| 268,366 | 11/1882 | Gillespie | 139/388 |
| 478,076 | 7/1892 | Asten . | |
| 1,920,106 | 7/1933 | Reichert . | |
| 2,040,657 | 5/1936 | Kops et al. | 139/388 |
| 3,441,005 | 4/1969 | Fink . | |
| 4,426,908 | 1/1984 | Ullmann . | |
| 4,745,883 | 5/1988 | Baggetta . | |
| 4,777,784 | 10/1988 | Ferguson . | |
| 4,993,366 | 2/1991 | Sager . | |
| 5,237,080 | 12/1993 | Morohashi et al. | 139/388 |
| 5,308,101 | 5/1994 | Monty . | |
| 5,402,832 | 4/1995 | Kamper et al. | 139/387 R |

FOREIGN PATENT DOCUMENTS

| | | | |
|---|---|---|---|
| 296983 | 5/1914 | Germany | 139/388 |

*Primary Examiner*—Andy Falik
*Attorney, Agent, or Firm*—Salter & Michaelson

[57] ABSTRACT

An elasticized double wall tubular cord includes an outer wall fabricated from a tube of woven material that is comprised of heavy duty, inelastic yarns, and an inner wall fabricated from a tube of woven material that is made partially of heavy duty, inelastic yarns and partially of elastic strands. The inner tube of woven material is stretchable lengthwise and attached to the outer tube of woven material along respective long edges when in stretched condition. The arrangement is such that when the inner tube of the tubular cord is in relaxed condition, the outer tube is compressed due to the compression force of the elastic strands of the inner tube for shortening the tubular cord.

6 Claims, 3 Drawing Sheets

ELASTICIZED DOUBLE WALL TUBULAR CORD

BACKGROUND AND SUMMARY OF THE INVENTION

This invention relates generally to cords and ropes, and more particularly to an elasticized double wall tubular cord which is used in commercial settings, such as for strapping, safety ropes and the like.

Elasticized cords useful for commercial and household purposes have been available for many years. Reference can be made to U.S. Pat. Nos. 478,076 to Asten, and 4,745,883 to Baggetta, these patents being representative of the prior art in this area. The patent to Asten discloses a strip of inelastic material which is stitched to completely surround a strip of elastic material. Although the specific manner in which the inelastic strip and the elastic strip are attached is not revealed in Asten, it is apparent that the elastic strip is attached to the inelastic strip in stretched condition.

The Baggetta patent discloses an inelastic tube having an elastic strip disposed therein which is attached to the tube in stretched condition by stitches. More specifically, a strip of cloth is formed into a tube by securing longitudinally extending sides of the cloth together by stitching. The elastic strip is inserted into the cloth tube and secured at its longitudinal ends with stitching. Next, the elastic strip is stretched until its length is equal to the length of the tube and the elastic strip is stitched to the tube along their entire length while taught.

Other patents of interest in this area are U.S. Pat. Nos. 1,920,106 to Reichert, 3,441,005 to Fink, 4,426,908 to Ullmann, 4,777,784 to Ferguson, 4,993,366 to Sager, and 5,308,101 to Monty.

One disadvantage associated with the prior art elasticized cords, including those found in Asten and Baggetta, is that they are difficult to manufacture since two separate and distinct fabric strips must be secured together. This oftentimes requires a separate and distinct machine to sew the two fabrics together. There is presently a need for an elasticized cord which is easier and more cost-efficient to manufacture than the prior art cords.

The present invention is directed to an elasticized double wall tubular cord comprising an outer wall fabricated from a tube of woven material that is comprised of heavy duty, inelastic yarns, and an inner wall fabricated from a tube of woven material that is comprised partially of heavy duty, inelastic yarns and partially of elastic fibers woven therein. The inner tube of woven material is stretchable lengthwise and attached to the outer tube of woven material along respective long edges thereof when in stretched condition. The arrangement is such that when the inner tube of the tubular cord is in relaxed condition, the outer tube is compressed due to the compression force of the elastic fibers of the inner tube for shortening the tubular cord.

Accordingly, among the several objects of the present invention are the provision of an elasticized double wall tubular cord fabricated from two tubes of woven material which is sturdy in construction and useful for commercial purposes, such as for strapping items in place, safety ropes and the like; the provision of such a double wall tubular cord which is economical to manufacture; and the provision of such a double wall tubular cord which can be manufactured from existing weaving equipment.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
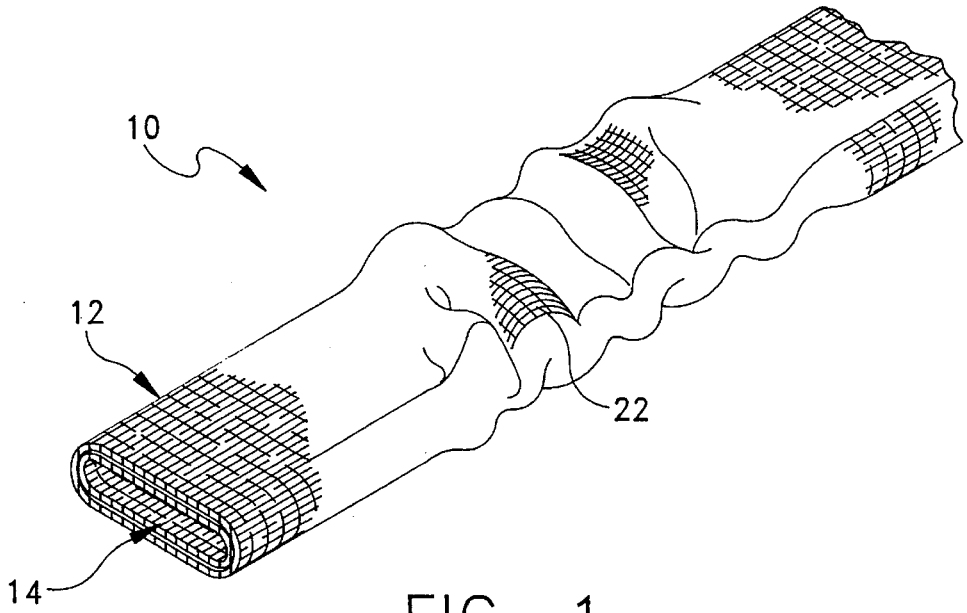
FIG. 1 is a perspective view of a section of elasticized double wall tubular cord in the form of a cord of the present invention.
Figure 2:
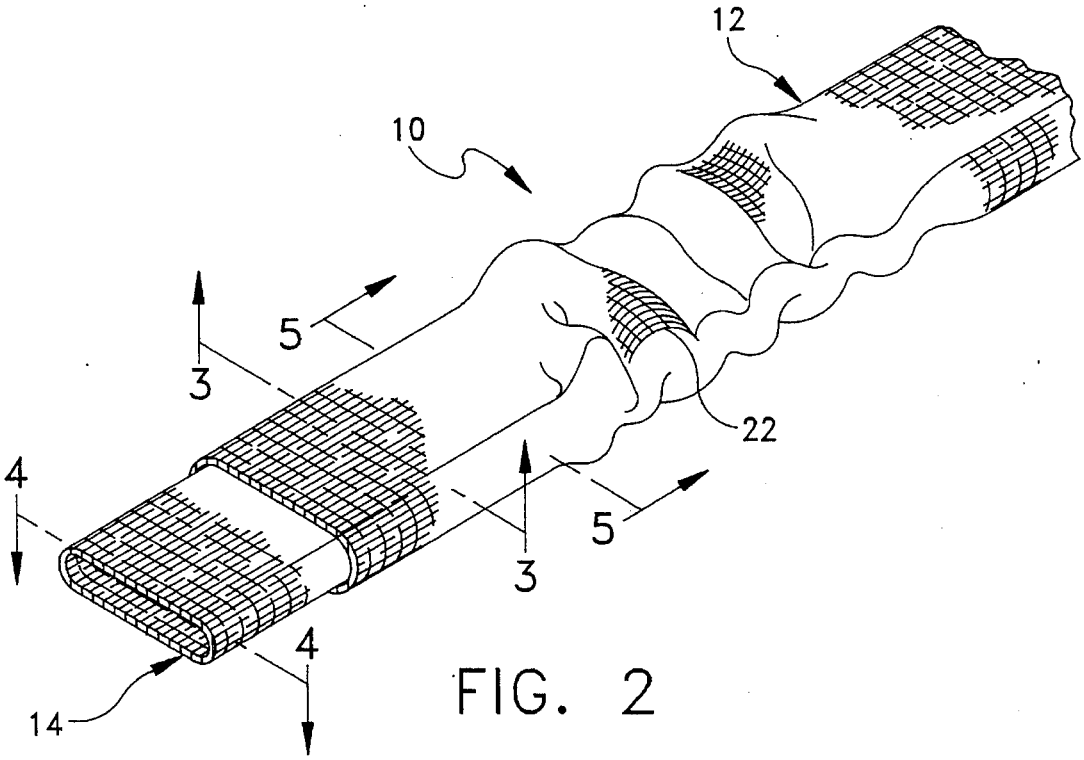
FIG. 2 is a perspective view similar to FIG. 1 illustrating an inner tube of the cord extending from an outer tube thereof.

Referring now to the drawings, and more particularly to FIGS. 1 and 2, there is generally indicated at 10 an elasticized double wall tubular cord of the present invention. The cord 10 is useful for many purposes, such as for strapping items in place, or for acting as a safety cord which is secured to a person performing dangerous activities, or for any other similar purpose, such as towing vehicles. It is important that the cord 10 be fabricated from heavy duty materials which are capable of withstanding excessive tensile loading. Furthermore, the cord 10 should be resistant to friction caused by rubbing against abrasive materials, and resistant to wear caused by weather (e.g., rain, snow, and hot and cold temperatures). Although preferred materials will be discussed in greater detail below, it should be understood that the cord 10 of the present invention can be fabricated from any other materials similar to materials described and still fall within the scope of the invention.

Figure 3:
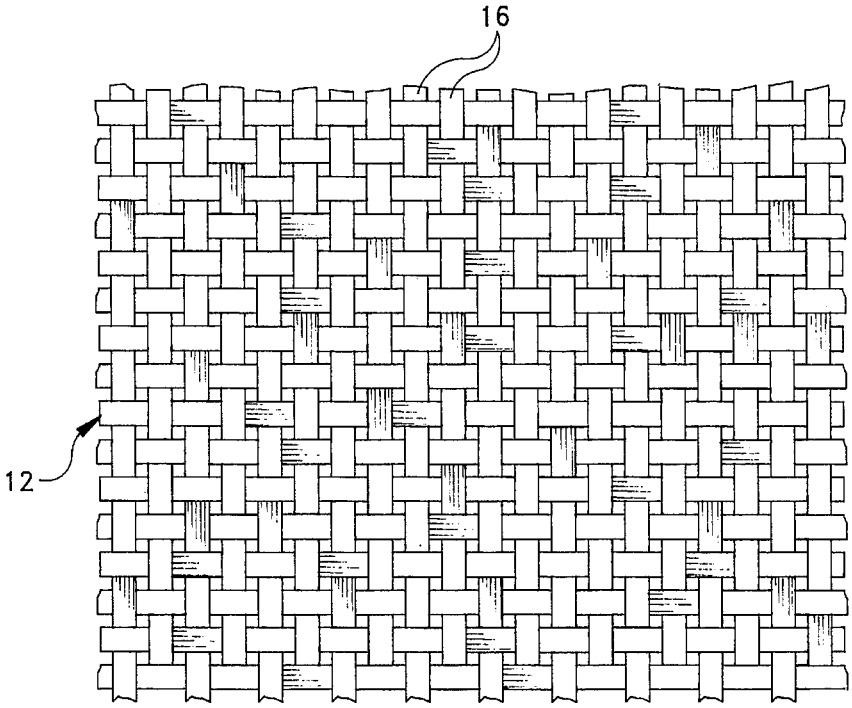
FIG. 3 is a cross-sectional view taken along line 3—3 of FIG. 2.

Referring to FIG. 3, the cord 10 comprises an outer wall fabricated from a tube of woven material, generally indicated at 12, and an inner wall also fabricated from a tube of woven material, generally indicated at 14. Preferably, the outer tube 12 is comprised of heavy duty, inelastic yarns or strands 16 (see FIG. 3) which are capable of withstanding large tensile forces and abrasion. One preferred embodiment of the present invention has the outer tube 12 fabricated from textured nylon which has been found to possess the requisite strength and abrasion resistant characteristics discussed above.

The inner tube 14 is comprised partially of heavy duty, inelastic yarns or strands 18, such as the yarns used to make the outer tube 12, and partially of elastic fibers or strands 20 woven into the inelastic strands 18. The inner tube 14 of woven material is stretchable lengthwise in such a manner that when in a relaxed condition, the inner tube 14 contracts much like a rubber band, and when in a stretched condition, the inner tube is spring loaded to contract. The outer and inner tubes 12, 14 are attached along respective long edges thereof when the inner tube 14 is in a stretched condition.

Figure 6:
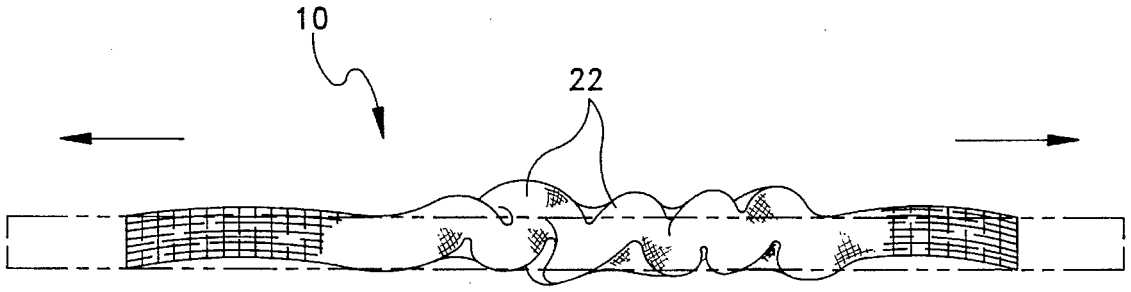
FIG. 6 is an elevational view of the cord.

The arrangement is such that when the inner tube 14 is in a relaxed condition, the outer tube 12 is compressed due to the compression force of the elastic strands 20 of the inner tube for shortening the tubular cord 10. Ridges, each indicated at 22, are formed in the cord 10 when the inner tube 14 is in relaxed condition. As illustrated in broken lines in FIG. 6, the outer tube straightens out as opposing tensile forces are applied to the cord 10 thereby eliminating the ridges 22.

Figure 4:
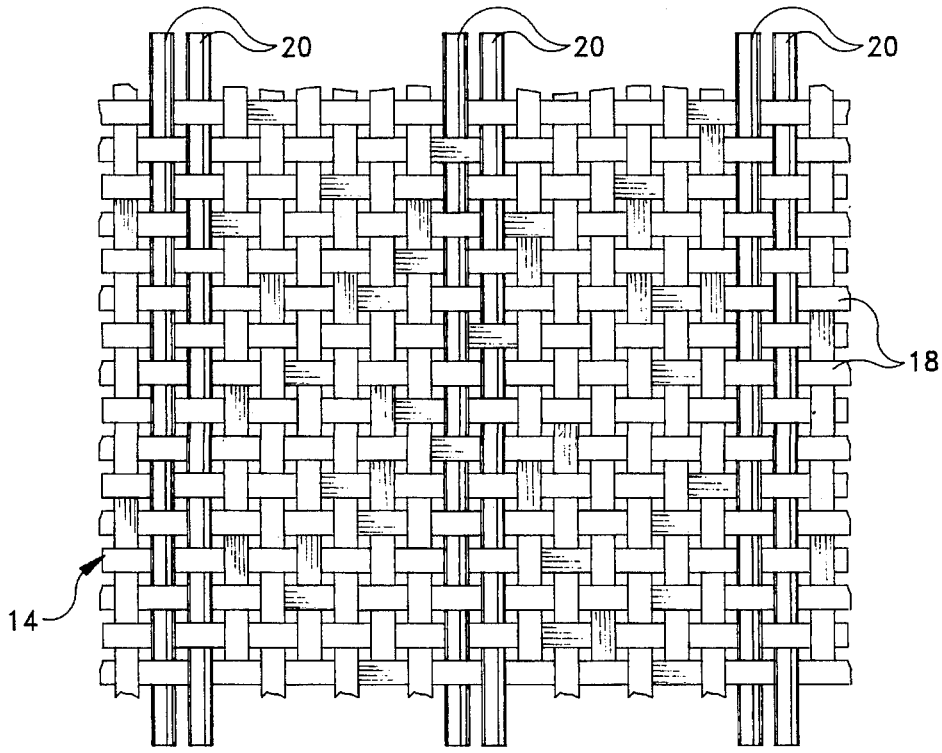
FIG. 4 is a cross-sectional view taken along line 4—4 of FIG. 2.

Referring to FIG. 4, the inner tube 14 is fabricated from untextured nylon material 18 having stretchable, long strands 20 made from rubber or synthetic rubber material woven therein. More specifically, the long elastic strands 20 of the inner tube 14 can be fabricated from a material known in the trade as spandex. The purpose of the elastic inner tube 14 is for providing tension on an item requiring a constant application of tension. The stretchable strands 20 are woven with inelastic strands 18 in a stretched condition. Thus, when the elastic strands 20 of the inner tube 14 are relaxed, the cord 10 compresses to form the shape having ridges 22 as illustrated in FIGS. 1 and 2. It should be understood that the inner tube 14, instead of being partially fabricated from stretchable strands 20, can be fabricated exclusively from stretchable strands and still fall within the scope of the present invention. The purpose for making the inner tube from partial inelastic and partial elastic strands 18, 20, respectively, is for increasing the strength of the inner tube 14. In the shown embodiment, there is approximately thirty to fifty percent elastic strands 20 which constitute the inner tube.

Figure 5:
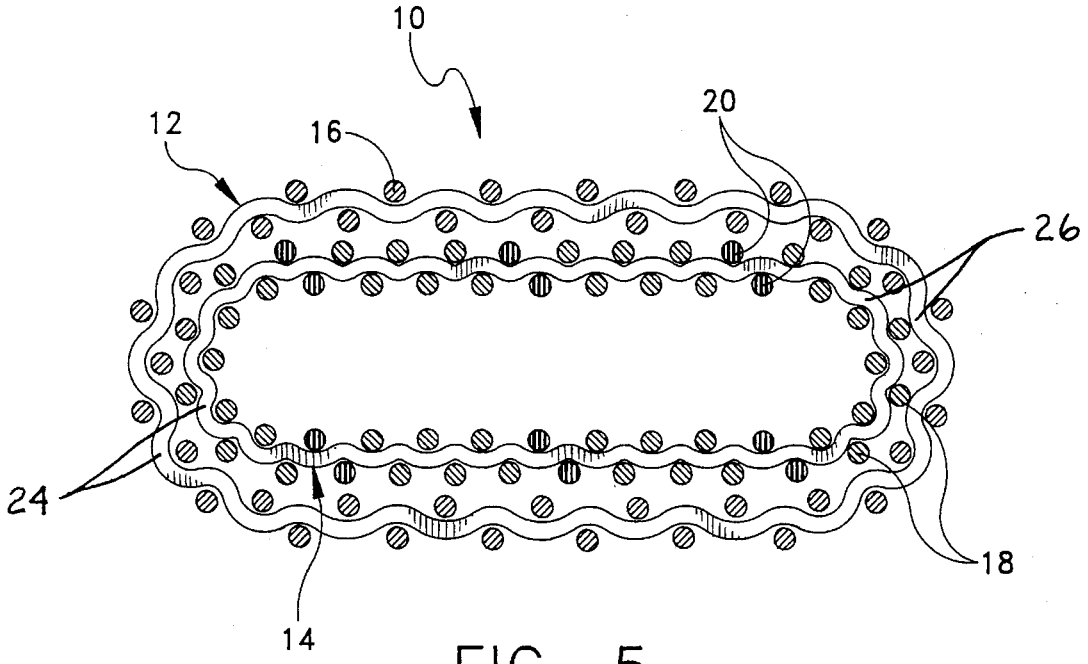
FIG. 5 is a cross-sectional view taken along line 5—5 of FIG. 2.

Referring to FIG. 5, the manner of attachment of the outer and inner tubes 12, 14 is as follows. A conventional weaving machine, such as a needle or shuttle loom, weaves a pair of socks which constitute the outer and inner tubes. The inner tube 14 is woven into the outer tube 12 along respective long edges 24, 26 thereof for providing a secure attachment of the inner tube 14 to the outer tube 12. Such attachment can be accomplished during the fabrication of the outer and inner tubes 12, 14 on the weaving machine. More specifically, the long, inelastic strands 18 of the inner tube 14 are interwoven with the cross-wise strands 16, 18 of the outer and inner tubes 12, 14, respectively, along respective long edges 24, 26 of the tubes 12, 14 for attaching the tubes together. The elastic strands 20 of the inner tube 14 are woven with the inelastic strands 18 in a stretched condition. This can be accomplished by maintaining tension on the strands 20 with a suitable tensioning device as they are woven with the inelastic strands 18 of the outer and inner tubes 12, 14. Once woven, the cord 10 assumes the configuration illustrated in FIGS. 1 and 2 with the elastic strands of the inner tube in relaxed condition.

It should be noted that the tubular cord 10 of the present invention is particularly economical to manufacture since it can be fabricated from a single weaving machine. Thus, tubular cord 10 made according to the principles of the present invention is less costly than prior art elasticized cords, and can be manufactured more quickly and conveniently. Also, since the cord 10 is made with the inner tube 14 woven to the outer tube 12 along respective long edges, the secure attachment of the tubes to one another is ensured.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An elasticized double wall tubular cord comprising an outer wall fabricated from a tube of woven material that is comprised of heavy duty, inelastic yarns, and an inner wall fabricated from a tube of woven material that is comprised at least partially of elastic woven strands, said outer and inner tubes having respective long edges, said inner tube of woven material being stretchable lengthwise and attached to the outer tube of woven material at respective long edges thereof when in stretched condition, the arrangement being such that when the inner tube of the tubular cord is in relaxed condition, the outer tube is compressed due to the compression force of the elastic strands of the inner tube for shortening the length of the tubular cord.

2. An elasticized double wall tubular cord as set forth in claim 1, said inner tube being fabricated partially of heavy duty, inelastic yarns wherein said elastic woven strands are woven therein.

3. An elasticized double wall tubular cord as set forth in claim 1, said heavy duty, inelastic yarns of the outer tube comprising textured nylon material.

4. An elasticized double wall tubular cord as set forth in claim 2, said inner tube being fabricated partially from untextured nylon material having said stretchable strands woven therein.

5. An elasticized double wall tubular cord as set forth in claim 4, said stretchable strands being woven with said inelastic strands in a stretched condition.

6. An elasticized double wall tubular cord as set forth in claim 1, said inner tube of woven material being woven into the outer tube of woven material along said respective long edges thereof for providing a secure attachment of the inner tube to the outer tube.

* * * * *